US005533823A

United States Patent [19]

Pierpont et al.

[11] Patent Number: 5,533,823

[45] Date of Patent: Jul. 9, 1996

[54] SEALED COSMETIC DISPENSER

[75] Inventors: Robert L. Pierpont, Meriden; John F. Cortes, Northford; Michael J. Fabrisi, Naugatuck; Kenneth F. Ryder, Prospect, all of Conn.

[73] Assignee: Rexam Cosmetic Packaging Inc., Torrington, Conn.

[21] Appl. No.: 412,891

[22] Filed: Mar. 29, 1995

[51] Int. Cl.[6] ..... A45D 40/00

[52] U.S. Cl. ..... 401/98; 215/342; 215/343; 401/213; 401/247; 401/262

[58] Field of Search ..... 401/98, 247, 243, 401/202, 213, 153, 262; 215/342, 343

[56] References Cited

U.S. PATENT DOCUMENTS

| | | | |
|---|---|---|---|
| 3,150,771 | 6/1962 | Seaver | 206/56 |
| 4,086,011 | 4/1978 | Kuparinen | 401/213 X |
| 4,380,403 | 4/1983 | Endres et al. | 401/247 X |
| 4,514,102 | 4/1985 | Ackerman et al. | 401/78 |
| 4,603,989 | 8/1986 | Ackerman et al. | 401/78 |
| 4,621,935 | 11/1986 | Sussman | 401/82 |
| 4,813,801 | 3/1989 | Cardia | 401/71 |
| 4,961,663 | 10/1990 | Iwamoto et al. | 401/78 |
| 4,966,479 | 10/1990 | Idec et al. | 401/68 |
| 5,076,720 | 12/1991 | Roger | 401/75 |
| 5,197,814 | 3/1993 | Lombardi et al. | 401/78 |
| 5,234,275 | 8/1993 | Gueret | 401/78 |
| 5,342,134 | 8/1994 | Lombardi et al. | 401/78 |

FOREIGN PATENT DOCUMENTS

| | | | |
|---|---|---|---|
| 1002469 | 10/1946 | France . | |
| 1410397 | 8/1965 | France | 401/247 |
| 1501043 | 9/1966 | France . | |
| 2291717 | 11/1974 | France . | |
| 3619684 | 12/1987 | Germany | 401/213 |
| 331064 | 8/1958 | Switzerland . | |

*Primary Examiner*—Steven A. Bratlie
*Attorney, Agent, or Firm*—McCormick, Paulding & Huber

[57] ABSTRACT

A sealed lipstick dispenser assembly has a base, a sleeve mounted within the base containing a lipstick pomade, and a cover mounted over the base and receiving a portion of the sleeve and pomade within a hollow interior. A bellows-like sealing member defines a sealing surface on one end, and a plurality of infolded or pleated portions to permit axial extension and retraction of the sealing surface. The sealing member is mounted on the base of the cover within the hollow interior, with the sealing surface on its free end. Upon closure of the cover on the base, the sealing surface is pressed into engagement with a lip of the sleeve due to the resilient nature of the infolded portions of the sealing member to form a fluid-tight seal, and thereby seal the lipstick pomade within the sleeve.

8 Claims, 1 Drawing Sheet

SEALED COSMETIC DISPENSER

FIELD OF THE INVENTION

The present invention relates to cosmetic dispensers, and more particularly, to sealed cosmetic dispensers for carrying water-containing and/or other fluid-containing cosmetics, such as lipsticks.

BACKGROUND INFORMATION

Many lipsticks are formulated with water, silicones and/or other fluids to provide a moist and relatively long-lasting formulation. The expected shelf life of such lipsticks may be on the order of 2 to 3 years, and once such a lipstick is purchased and opened, its expected useful life may be on the order of another several months to a year. Currently available lipstick dispensers typically do not provide a means for sealing the lipstick so as to prevent either a loss of moisture, such as water, silicones or other fluids, or the absorption of moisture during either the lipstick's shelf life or useful life after the dispenser is first opened. A loss or gain of moisture may undesireably affect a lipstick formulation and render it defective.

Other lipstick dispensers with means for sealing the lipsticks typically include cooperating parts, wherein one part is received within the other to form a seal along the interface of the cooperating parts and thereby seal the lipstick within the dispenser. One disadvantage of these types of dispensers is that the cooperating parts must be manufactured with relatively exact dimensions in order to ensure that the parts precisely cooperate with one another and form a fluid-tight seal. If, for example, one of the cooperating parts is not correctly positioned within the dispenser, and/or is not manufactured within precise tolerances, the seal may be defective. Effectively avoiding these problems typically leads to additional manufacturing expense.

It is an object of the present invention to overcome the drawbacks and disadvantages of prior art dispensers for water-containing and/or other fluid-containing cosmetics.

SUMMARY OF THE INVENTION

The present invention is directed to a cosmetic dispenser comprising a base assembly, and a hollow sleeve mounted with the base assembly for receiving a cosmetic substance, such as a lipstick pomade. A cover defining a hollow interior is mounted on the base assembly for receiving at least a portion of the base and covering an open end of the hollow sleeve. A bellows-like sealing member is mounted within the hollow interior of the cover, and defines a sealing surface on its free end, and at least one infolded portion or pleat for permitting axial expansion and contraction of the sealing member. Upon attachment of the cover to the base assembly, the sealing surface is pressed into engagement with the open end of the sleeve due to the resilient nature of the infolded portions or pleats, and in turn forms a substantially fluid-tight seal to prevent the loss of moisture from the cosmetic substance.

One advantage of the cosmetic dispenser assembly of the present invention, is that the bellows-like construction of the sealing member permits substantial axial expansion and contraction of the sealing member to effectively seal the open end of the base assembly. Accordingly, the need for precisely-dimensioned cooperating parts to seal the cosmetic substance within the base assembly, as with the prior art cosmetic dispensers described above, is avoided.

Other objects and advantages of the present invention will become apparent in view of the following detailed description and accompanying drawings.

DETAILED DESCRIPTION OF A PREFERRED EMBODIMENT

Figure 1:
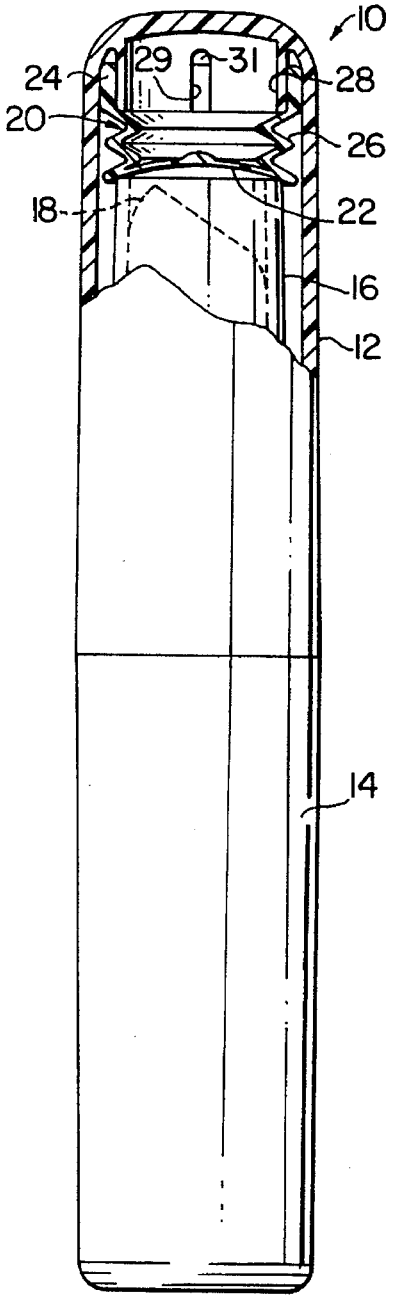
FIG. 1 is a front plan view in partial cross section of a lipstick dispenser assembly embodying the present invention.

In FIG. 1, a lipstick dispenser assembly embodying the present invention is indicated generally by the reference numeral 10. The lipstick dispenser 10 comprises a cover including a cover shell 12, a base assembly including a base shell 14, and a hollow, cylindrical sleeve 16 mounted and received within the base shell. As shown in phantom lines in FIG. 1, a lipstick pomade 18 is mounted within a carrier (not shown) and received within the sleeve 16. As with most commercially-available lipstick dispensers, upon removal of the cover, rotation of the base shell 14 relative to the sleeve 16 causes the lipstick pomade 18 to move between a retracted position, as shown in phantom lines in FIG. 1, and an extended position beyond the open end of the sleeve 16 for application of the lipstick.

As will be recognized by those skilled in the pertinent art, there are numerous known mechanisms for permitting extension and retraction of the lipstick pomade 18. As one example, at least one cam may be formed on the pomade carrier, wherein the cam extends through a longitudinal slot of the sleeve, and is received within a helical groove formed within the base shell or within an insert received within the base shell. Rotation of the base shell causes relative movement of the cam and helical slot, which causes the cam to travel through the longitudinal slot, and in turn drives the pomade between the extended and retracted positions depending upon the direction of rotation. As will be recognized by those of ordinary skill in the pertinent art, any of the known mechanisms for retracting and extending the pomade may be used in the lipstick dispenser of the present invention.

As shown in FIGS. 1 through 4, the lipstick dispenser 10 further comprises a bellows-like sealing member or unit 20 mounted on the closed end or base of the cover shell 12. The bellows 20 defines a closed end 22, an open end defined by a flange 24, and a plurality of pleated or infolded portions 26 to permit expansion and contraction of the bellows in its axial direction. As is described further below, the closed end 22 of the bellows defines a sealing surface, and the infolded portions 26 permit axial extension and retraction of the sealing surface to engage the open end of the sleeve 16 and form a substantially fluid-tight seal. The bellows 20 is made of a flexible, polymeric material with good moisture-barrier properties, and is preferably an olefin, such as polypropylene or polyethylene. As will be recognized by those skilled in the pertinent art, however, the polymeric material of the bellows should also be selected based upon the particular cosmetic formulation used to effectively prevent either the absorption or loss of fluids into or from the formulation. For example, a solvent-based cosmetic may require a more solvent-resistant polymer, such as the ionomer resin sold under the mark Surlyn™.

Figure 2:
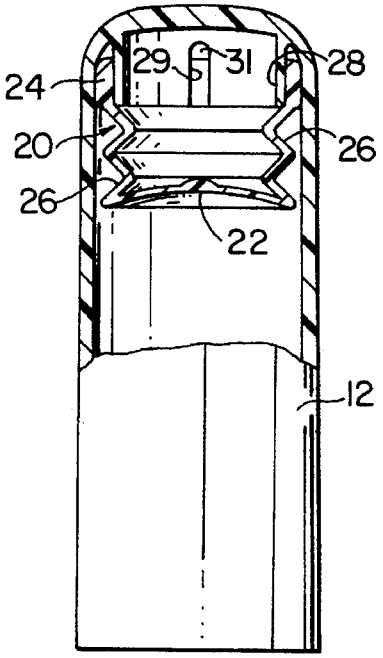
FIG. 2 is a front plan view in partial cross section of the cover and bellows-like sealing member of the lipstick dispenser assembly of FIG. 1.
Figure 3:
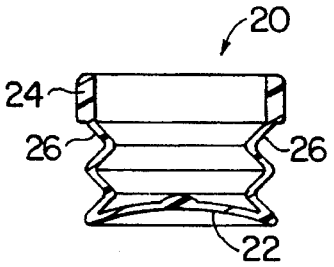
FIG. 3 is a cross-sectional view of the bellows-like sealing member of FIGS. 1 and 2.
Figure 4:
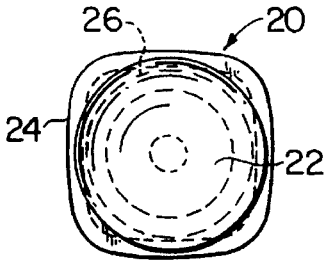
FIG. 4 is a bottom plan view of the bellows-like sealing member of FIGS. 1–3.

As shown in FIGS. 1 and 2, the cover shell 12 includes a mounting flange 28 projecting inwardly from the closed end of the cover, spaced inwardly from the exterior wall, and defining a peripheral slot therebetween. The flange 24 of the bellows is received within the peripheral slot, and is fixed in place by, for example, using a suitable adhesive or forming a press fit between the flange and the surfaces forming the slot. The mounting flange 28 also defines a plurality of elongated apertures, shown typically at 29, which extend beyond the top edge of the flange 24 of the bellows, and thus form a plurality of air passages, shown typically at 31, to permit air to pass into and from the interior of the bellows upon extension and retraction of the bellows.

As shown in FIGS. 1 and 2, the bellows 20 extends in the axial direction of the cover and lipstick dispenser assembly, and is axially expandable and contractible for purposes of sealing the lipstick pomade within the sleeve 16. As shown in FIG. 2, when the cover shell 12 is removed from the lipstick dispenser assembly, the bellows 20 is permitted to expand into an axially-extended position due to the flexible, resilient nature of the polymeric material and the infolded or pleated construction. Then, when the cover shell 12 is placed over the sleeve 16 and attached to the base, as shown in FIG. 1, the closed end 22 of the bellows engages the open end or lip of the sleeve 16, and in turn causes the bellows to axially contract.

As shown in FIG. 1, the resilient nature of the polymeric material and construction of the infolded or pleated portions 26 causes the closed end or sealing surface 22 of the bellows to press against the lip of the sleeve 16 when the cover shell is attached to the base, and in turn form a substantially fluid-tight seal along the entire lip to effectively seal the pomade within the sleeve. Accordingly, the infolded portions 26 effectively function as a spring to permit axial movement of the sealing surface and to press the sealing surface into engagement with the open end of the sleeve.

As will be recognized by those skilled in the pertinent art, the cover shell may be attached to the base assembly by employing any of numerous known means for attachment, such as by forming an interference fit between the open end of the cover shell and a corresponding flange on the base assembly.

One advantage of the present invention, is that the bellows-like construction of the sealing member 20 permits substantial extension and retraction in its axial direction in order to form an effective seal along the open end of the sleeve. As a result, the need for precisely dimensioned cooperating parts for sealing, as with the prior art lipstick dispenser assemblies described above, may be avoided. Indeed, relatively substantial variations in dimensions between the cover and sleeve, for example, may be tolerated while maintaining a fluid-tight seal.

As will be recognized by those skilled in the pertinent art, numerous modifications may be made to the above-described and other embodiments of the present invention, without departing from the scope of the appended claims. Accordingly, the preferred embodiment of the invention has been described above in an illustrative, as opposed to a limiting sense.

What is claimed is:

1. A cosmetic dispenser assembly, comprising:

a base defining a hollow chamber for receiving a cosmetic substance, and including an edge defining the periphery of an opening for accessing the cosmetic substance;

a cover adapted for attachment to the base and defining a hollow interior receiving at least a portion of the base and covering the opening to the cosmetic substance upon attachment of the cover to the base; and a sealing member defining a flange mounted within the hollow interior of the cover, a peripheral sealing surface, and at least one infolded portion connected between the flange and the sealing surface, the at least one infolded portion and sealing surface being movable to an extended position upon removal of the cover from the base and to a retracted position with the sealing surface in peripheral engagement with the edge of the opening upon attachment of the cover to the base, the at least one infolded portion being formed of a flexible material for pressing the sealing surface into peripheral engagement with the edge defining the opening and effecting a fluid-tight seal along the peripheral edge to thereby seal the cosmetic substance received within the hollow chamber.

2. A cosmetic dispenser assembly as defined in claim 1, wherein the cover defines an open end and a closed end, and the flange of the sealing member is fixedly mounted to the closed end of the cover, and the sealing member comprises a plurality of flexible infolded portions formed between the flange and the sealing surface to permit axial extension and retraction of the sealing surface.

3. A cosmetic dispenser assembly as defined in claim 1, wherein the base includes a sleeve defining a substantially cylindrical chamber for receiving the cosmetic substance, and the sleeve defines the peripheral edge of the opening for accessing the cosmetic substance.

4. A cosmetic dispenser assembly as defined in claim 3, wherein the cover defines an axially-elongated chamber receiving the open end of the sleeve, and the flange of the sealing member is mounted on a closed end of the cover.

5. A cosmetic dispenser assembly, comprising:

a base assembly defining an axially-elongated chamber receiving a lipstick pomade, and an open end defined by a peripheral surface to permit passage of the lipstick pomade therethrough;

a cover adapted for attachment to the base assembly and defining a hollow interior receiving at least a portion of the base assembly and covering the open end upon attachment of the cover to the base assembly; and a sealing unit mounted on a first end within the hollow interior of the cover, the sealing unit including a peripheral sealing surface on a second end opposite the first end and means including at least one flexible infolded portion connected between the sealing surface and the first end for permitting axial extension and retraction of the sealing surface, the sealing surface being movable from an extended position to a retracted position peripherally engaged with the peripheral surface of the open end of the base assembly upon attachment of the cover to base assembly, thereby forming a substantially fluid-tight seal between the sealing surface and the peripheral surface of the base assembly to seal the lipstick pomade within the base assembly.

6. A cosmetic dispenser assembly as defined in claim 5, wherein the base assembly includes an axially-elongated wall defining the chamber, and the cover defines a hollow, axially-elongated interior receiving the axially-elongated wall, and the sealing unit is fixedly mounted on its first end to a closed end of the cover.

7. A cosmetic dispenser assembly as defined in claim 5, wherein the means for permitting axial extension and retraction includes a plurality of flexible infolded portions formed between the sealing surface and the first end of the sealing unit.

8. A cosmetic dispenser assembly as defined in claim 7, wherein the plurality of flexible infolded portions and sealing surface define a bellows-like construction.

* * * * *